US010036596B2

(12) United States Patent
Lan

(10) Patent No.: US 10,036,596 B2
(45) Date of Patent: Jul. 31, 2018

(54) COMBINATION STRUCTURE OF HEAT DISSIPATION MODULE

(71) Applicant: ASIA VITAL COMPONENTS CO., LTD., New Taipei (TW)

(72) Inventor: Wen-Ji Lan, New Taipei (TW)

(73) Assignee: ASIA VITAL COMPONENTS CO., LTD., New Taipei (TW)

( * ) Notice: Subject to any disclaimer, the term of this patent is extended or adjusted under 35 U.S.C. 154(b) by 247 days.

(21) Appl. No.: 14/992,027

(22) Filed: Jan. 11, 2016

(65) Prior Publication Data

US 2017/0198980 A1 Jul. 13, 2017

(51) Int. Cl.
*F28D 15/02* (2006.01)
*F28D 15/04* (2006.01)

(52) U.S. Cl.
CPC ..... *F28D 15/0275* (2013.01); *F28D 15/04* (2013.01)

(58) Field of Classification Search
CPC ..... F28D 15/2033; F28D 15/0275; H07K 7/20336
USPC ..... 165/80.3, 104.33, 185; 361/700
See application file for complete search history.

(56) References Cited

U.S. PATENT DOCUMENTS 7,245,494 B2 * 7/2007 Cheng ..... G06F 1/20 165/104.26
7,443,679 B2 * 10/2008 Li ..... H01L 23/4006 165/104.33
7,768,784 B2 * 8/2010 Lai ..... H01L 23/4093 165/104.33
2005/0098304 A1 * 5/2005 Lin ..... H01L 23/427 165/104.33
2005/0257920 A1 * 11/2005 Sheng ..... F28D 15/0275 165/104.33
2008/0314556 A1 * 12/2008 Zhou ..... F28D 15/0266 165/80.3
2010/0073877 A1 * 3/2010 Yu ..... H01L 23/4093 361/697

* cited by examiner

*Primary Examiner* — Allen Flanigan

(57) ABSTRACT

A combination structure of heat dissipation module includes a heat dissipation set and at least one heat pipe, which is extended through the heat dissipation set. The heat dissipation set includes a first, a second, and a third portion, which are located respectively corresponding to a heat-dissipation section, a curved section, and a heat-absorption section of the heat pipe. The second and the third portion of the heat dissipation set are respectively provided with a plurality of second and third slots, which are gradually extended according to a length of the curved section and a horizontal length of the heat-absorption section of the heat pipe, and the third portion internally defines a receiving opening communicable with the third slots, so as to effectively remove heat through using the curved section of the heat pipe.

6 Claims, 9 Drawing Sheets

COMBINATION STRUCTURE OF HEAT DISSIPATION MODULE

FIELD OF THE INVENTION

The present invention relates to a heat dissipation module, and more specifically, to a combination structure of a heat dissipation module which ingrates a plurality of heat pipes and heat radiation fins thereinto.

BACKGROUND OF THE INVENTION

As the advancement of the currently available electronic products has been largely upgraded, heat generated by electronic elements in those products is also largely increased. Therefore, heat dissipation units are widely used to dissipate the heat to keep the electronic products working normally. Several groups of heat radiation fin stack together with heat pipes is one of the most widely used heat dissipation devices.

A conventional heat dissipation device includes a heat-conducting seat, a plurality of U-shaped heat pipes, and a plurality of heat radiation fins. The heat-conducting seat has a bottom attached to a heat-generating element, such as a Central Processing Unit (CPU) or a Graphics Processing Unit (GPU). Each heat pipe includes a horizontal heat-absorption section and a heat-dissipation section extended from two ends of the heat-absorption section. The heat-absorption section is embedded in one side of the heat-conducting seat, and the heat radiation fins are extended through and connected to the heat-dissipation section of the heat pipe. Therefore, heat produced by the heat-generating element is transferred to the heat-conducting seat, then to the heat pipe. Thereafter, the heat is dissipated into the ambient air after transferred from the heat pipe to the heat radiation fins.

The heat generated by the heat-generating element is removed by the conventional heat dissipation device. However, each the heat radiation fin can only be connected to a beeline section, i.e. heat-dissipation section, of each heat pipe in conventional heat dissipation device, but a curved section of each heat pipe has no heat dissipation function. Currently, in conventional technique, the curved section of the heat pipe is still used for air-convection but cannot be extended through and connected to heat radiation fins, causing lowing utilization ratio of the heat pipe and failing to enhance heat dissipation area. As a result, how to effectively use the curved section of the heat pipe to remove the heat and strengthen the whole heat dissipation fixing structure are important issues for the inventor to develop and improve.

SUMMARY OF THE INVENTION

To solve the above problems, a primary object of the present invention is to provide a combination structure of heat dissipation module that effectively integrates a curved section of a heat pipe thereinto to transfer heat.

Another object of the present invention is to provide a heat dissipation set that has a plurality of slots, which are gradually extended according to a length of the curved section and a horizontal length of the heat-absorption section of the heat pipe without the risk of an intervention occurred between the heat dissipation set and the heat pipe.

A further object of the present invention is to provide a combination structure of heat dissipation module that enables the heat pipe, the heat-dissipation set, and the base can be fixedly connected to one another.

A still further object of the present invention is to provide a combination structure of heat dissipation module that has increased heat transfer effect by using a plurality of heat radiation fins or vapor chambers to be extended through and correspondingly connected to the curved section of the heat pipes.

To achieve the above and other objects, the combination structure of heat dissipation module provided according to the present invention includes a heat dissipation set and at least one heat pipe. The heat pipe has a heat-absorption, at least one heat-dissipation, and at least one curved section connected to the heat-absorption and the heat-dissipation section. The heat-absorption section has a horizontal length; the heat-dissipation section has a cross-section area, and a cross-section length is defined between a rightmost and a leftmost edge of the cross-section area; and the curved section has a curved length. The heat dissipation set penetrated through the heat pipe includes a first, a second, and a third portion, which are located respectively corresponding to a heat-dissipation section, a curved section, and a heat-absorption section of the heat pipe. The first portion is provided with a plurality of first slots, each of which has a first slot length corresponding to a cross-section length of the heat-dissipation section of the heat pipe. The second and the third portion of the heat dissipation set are respectively provided with a plurality of second and third slots, which are gradually extended according to a length of the curved section and a horizontal length of the heat-absorption section of the heat pipe, and the third portion internally defines a receiving opening communicable with the third slots, so as to effectively remove heat through using the curved section of the heat pipe.

In an embodiment, the lengths of both the second and the third slots are longer than those of the first slots.

In an embodiment, the receiving opening is used for a fixing member to be located therein; and the fixing member includes at least one holding section and at least one clamping section clamped onto the heat-absorption section of the heat pipe.

In an embodiment, the combination structure of heat dissipation module further includes a base located under the third portion of the heat dissipation set; the base has a top and a bottom side; and the top side of the base is connected to the holding section of the fixing member, whereas the bottom side is attached to a heat-generating element.

In an embodiment, the base is provided with at least one groove, which is extended through both the top and the bottom side of the base for receiving the heat-absorption section of the heat pipe, and has two inner surfaces which curve in a direction of an outer surface of the curved section of the heat pipe.

In an embodiment, the first, the second, and the third portion of the heat dissipation set respectively consists of a plurality of stacked first heat radiation fins, a plurality of stacked second heat radiation fins or a vapor chamber, and a plurality of stacked third heat radiation fins or a vapor chamber.

BRIEF DESCRIPTION OF THE DRAWINGS

The structure and the technical means adopted by the present invention to achieve the above and other objects can be best understood by referring to the following detailed description of the preferred embodiments and the accompanying drawings, wherein.

DETAILED DESCRIPTION OF THE PREFERRED EMBODIMENTS

Figure 1A:
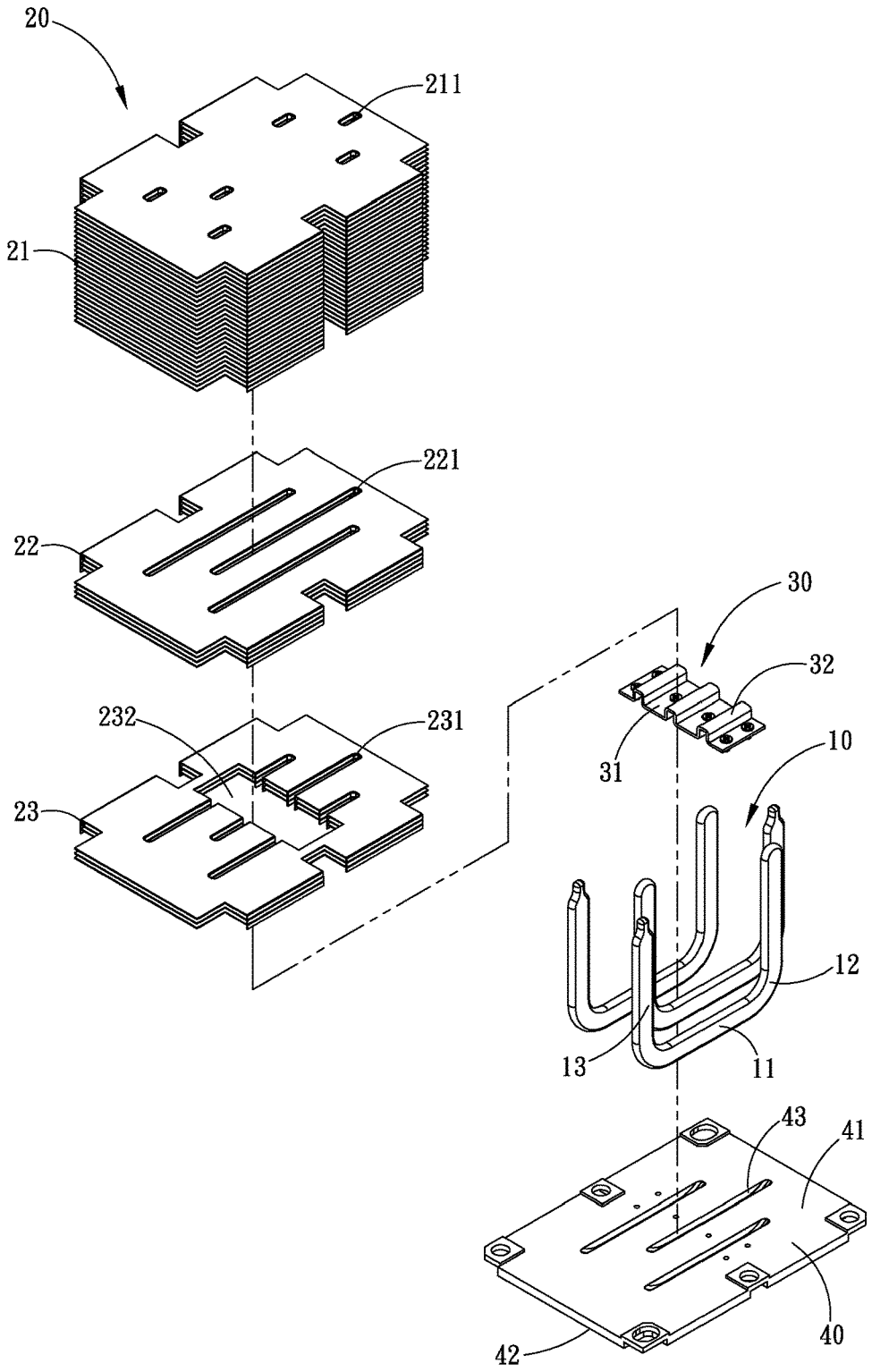
FIG. 1A is a fully exploded perspective view of a combination structure of a heat dissipation module according to a preferred embodiment of the present invention.

The present invention will now be described with some preferred embodiments thereof and by referring to the accompanying drawings. For the purpose of easy to understand, elements that are the same in the preferred embodiments are denoted by the same reference numerals.

Figure 1B:
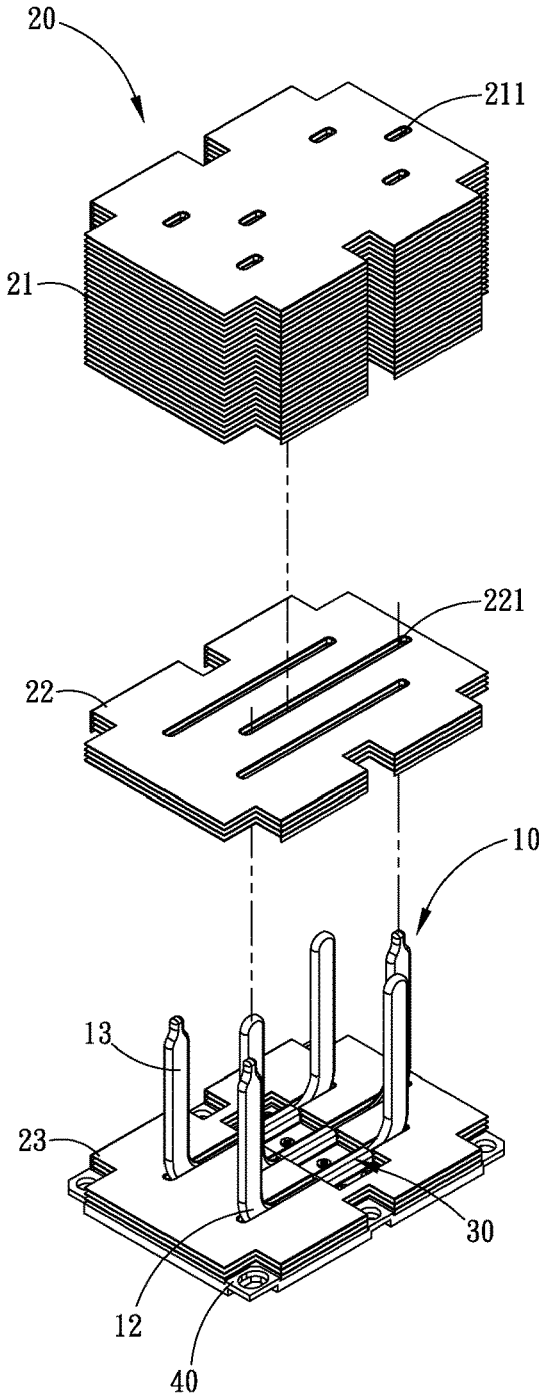
FIG. 1B is a partially assembled perspective view of FIG. 1A.
Figure 1C:
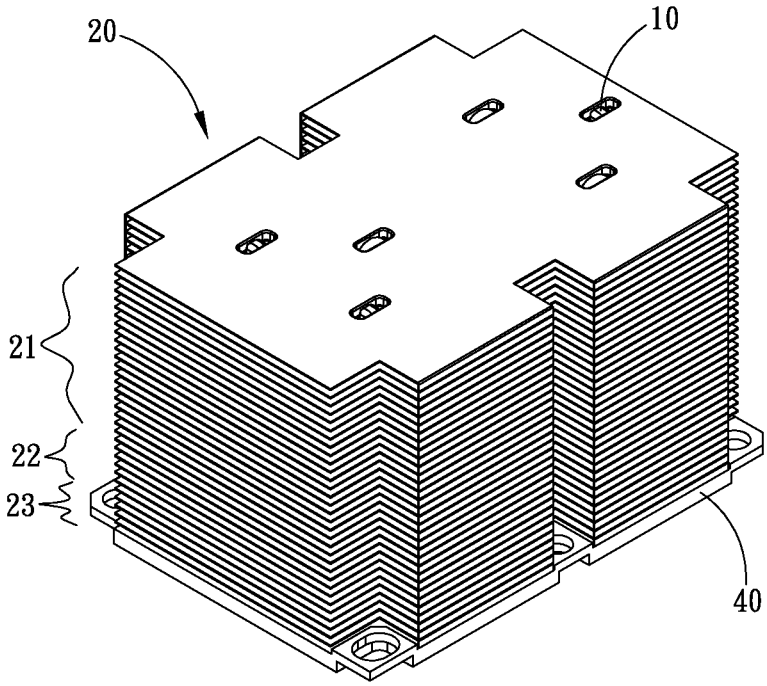
FIG. 1C is a fully assembled perspective view of FIG. 1A.
Figure 1D:
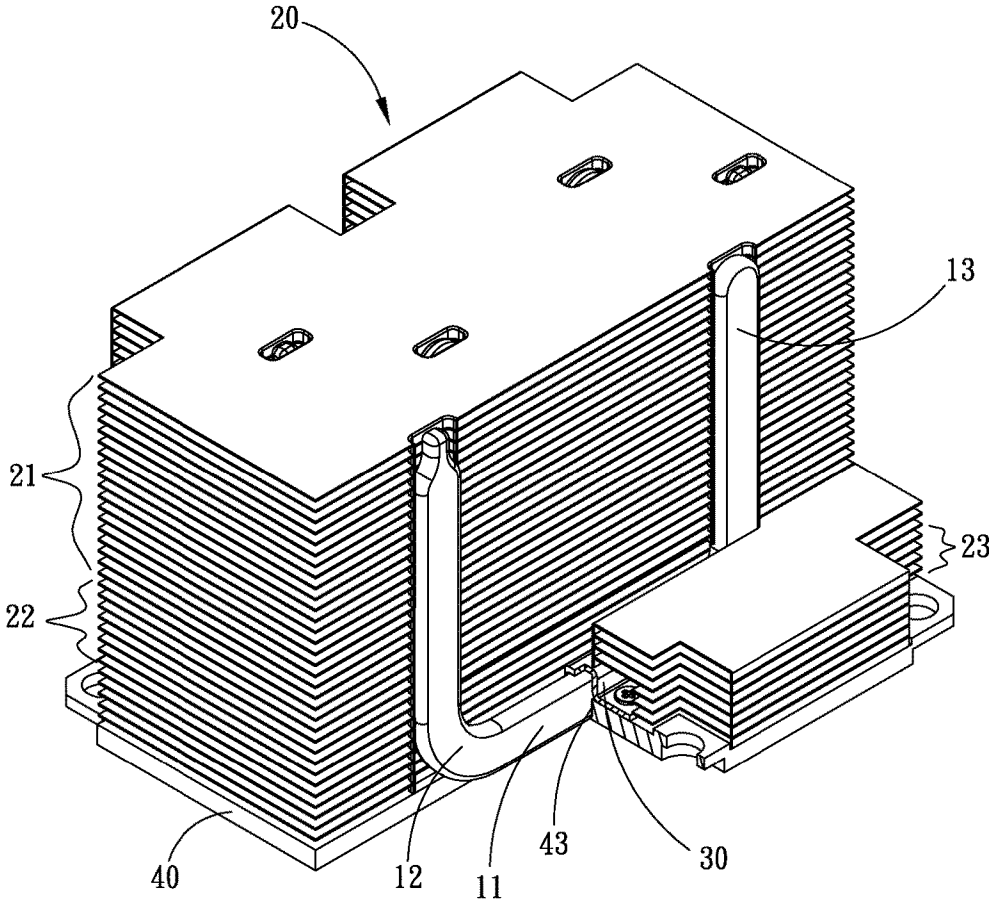
FIG. 1D is an assembled, partially sectional view of FIG. 1A.
Figure 1E:
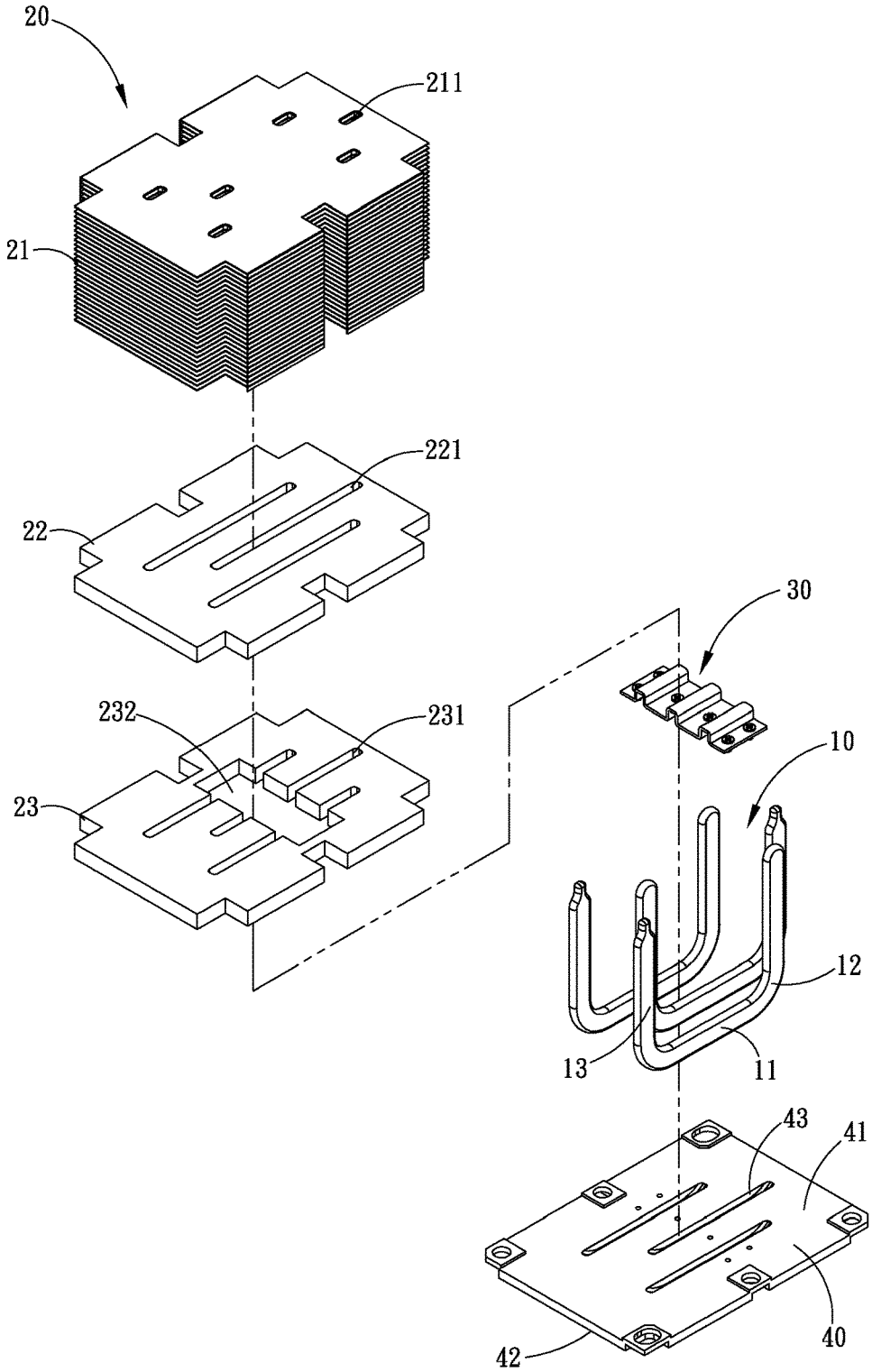
FIG. 1E is an exploded perspective view of a variant of the combination structure of the heat dissipation module according to the preferred embodiment of the present invention.

Please refer to FIGS. 1A to 1C, which are fully exploded, partially assembled perspective views, respectively, of a combination structure of a heat dissipation module according to a preferred embodiment of the present invention, FIG. 1D, which is a an assembled, partially sectional view of FIG. 1A, and FIG. 1E, which is an exploded perspective view of a variant of the combination structure of the heat dissipation module according to the preferred embodiment of the present invention. As shown, the combination structure of the heat dissipation module includes at least one heat pipe 10, a heat dissipation set 20, a fixing member 30, and a base 40. For the purpose of conciseness, the present invention is also briefly referred to as the combination structure.

In this illustrated embodiment, there are three U-shaped heat pipes 10, each of which has a heat-absorption section 11, at least one heat-dissipation section 13, and at least one curved section 12 connected both to the heat-absorption and the heat-dissipation section 11, 13. Since the heat pipes 10 are U-shaped, two curved sections are provided; however, each heat pipe can be L-shaped with one curved section in other possible embodiments.

Figure 2A:
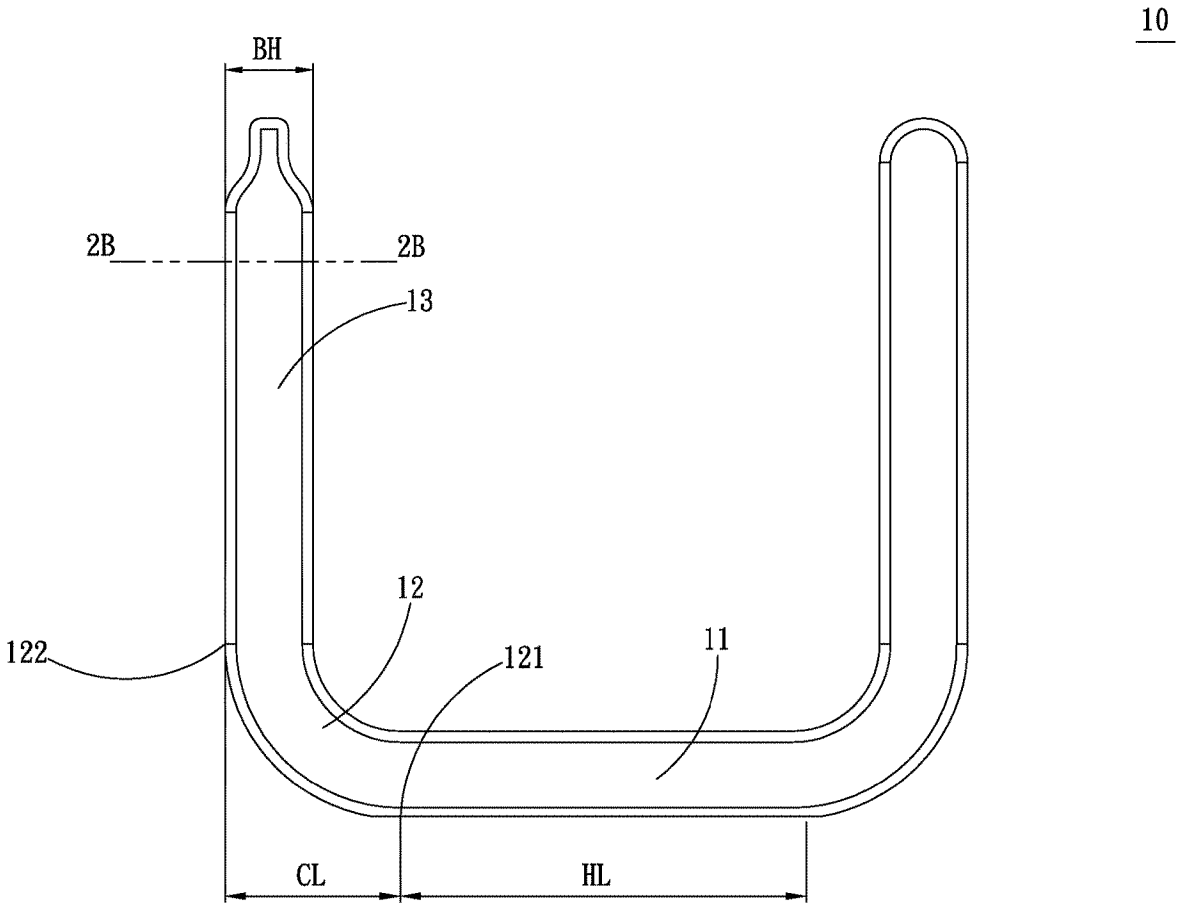
FIG. 2A is a sectional view of a heat pipe included in the combination structure of the heat dissipation module according to the preferred embodiment of the present invention.
Figure 2B:
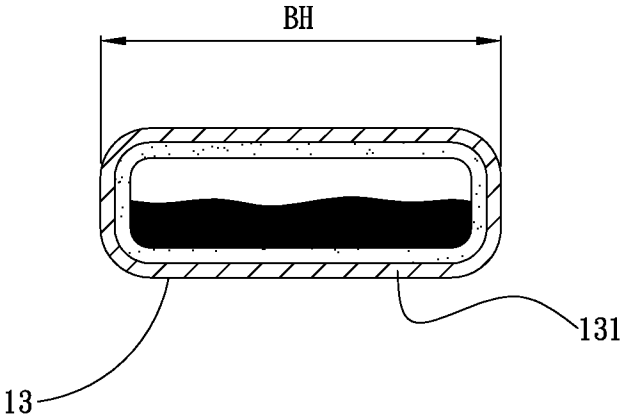
FIG. 2B is a sectional view of the heat pipe from another angle of FIG. 2A.

Please refer to FIGS. 2A and 2B, which are two sectional views of a heat pipe from two angles included in the combination structure of the heat dissipation module according to the preferred embodiment of the present invention. As shown, the curved section 12 of the heat pipe 10 has an initial end 121, which is located between the heat-absorption section 11 and the curved section 12, and a final end 122, which is located between the curved section 12 and the heat-dissipation section 13. A horizontal length HL is a beeline distance and defined between two initial ends, since each heat pipe 10 is U-shaped in this illustrated embodiment, but it can be defined between one initial end 121 and one free end of the heat-absorption section 11, when each heat pipe 10 is L-shaped in other possible embodiments. A cross-section length BH is defined between a rightmost and a leftmost edge of the cross-section area 131; and the curved section 12 has a curved length CL defined between the initial and the final end 121, 122. In this illustrated embodiment, the heat pipe 10 is preferably a flat heat pipe whose cross-section area is rectangle.

Figure 4A:
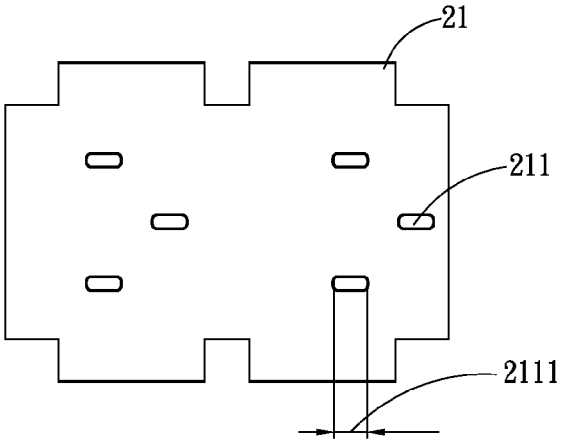
FIG. 4A is a top view of a first portion included in the combination structure of the heat dissipation module according to the preferred embodiment of the present invention.
Figure 4B:
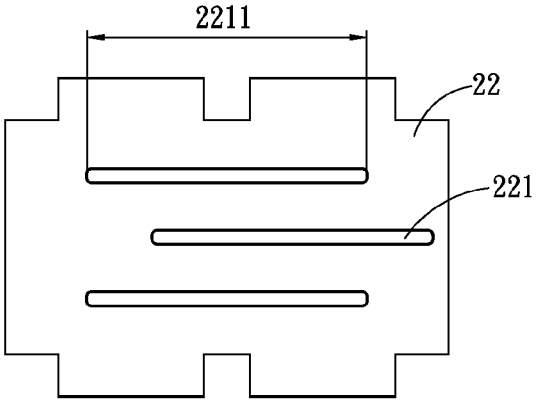
FIG. 4B is a top view of a second portion included in the combination structure of the heat dissipation module according to the preferred embodiment of the present invention.
Figure 4C:
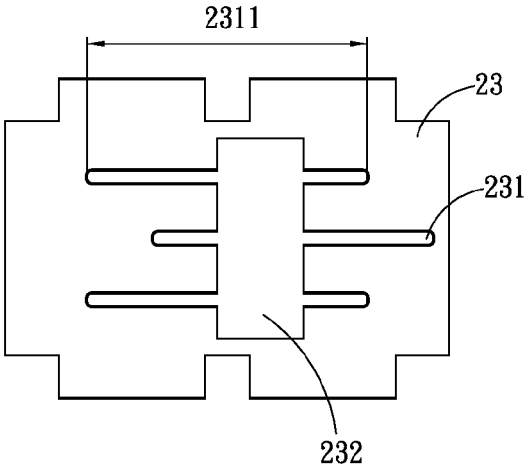
FIG. 4C is a top view of a third portion included in the combination structure of the heat dissipation module according to the preferred embodiment of the present invention.

Referring to FIGS. 1A to 1E and FIGS. 2A and 2B again, along with FIGS. 4A to 4C, which are three top views, respectively, of a first portion, a second portion, and a third portion included in the combination structure of the heat dissipation module according to the preferred embodiment of the present invention. As shown, The heat dissipation set 20 is penetrated through the heat pipe 10 includes a first, a second, and a third portion 21, 22, 23, which are located respectively corresponding to a heat-dissipation section 13, a curved section 12, and a heat-absorption section 11 of the heat pipe 10. The first portion 21 is provided with a plurality of first slots 211, each of which has a first slot length 2111 shown in FIG. 4A corresponding to a cross-section length BH of the heat-dissipation section 13 of the heat pipe 10 shown in FIG. 2. The second and the third portion 22, 23 of the heat dissipation set 20 are respectively provided with a plurality of second and third slots 221, 231, which respectively has a second slot length 2211 shown in FIG. 4B and a third slot length 2231 shown in FIG. 4C, which are gradually extended according to a length of the curved section CL and a horizontal length HL of the heat-absorption section 11 of the heat pipe 10. That is, the second slot and the third slot length 2211, 2311 respectively equal the curved length CL plus the horizontal length HL. The third portion 23 internally defines a receiving opening 232 communicable with the third slots 231. The lengths of both the second and the third slots 2211, 2311 are longer than those of the first slots 2111. In this illustrated embodiment, the first, the second, and the third portion 21, 22, 23 of the heat dissipation set 20 respectively consists of a plurality of stacked first heat radiation fins, a plurality of stacked second heat radiation fins or a vapor chamber, and a plurality of stacked third heat radiation fins or a vapor chamber. In other possible embodiment, the second and/or the third portion 22, 23 of the heat dissipation set 20 can be a vapor chamber.

The receiving opening 232 is used for a fixing member 30 to be located therein; and the fixing member 30 includes at least one holding section 31 and at least one clamping section 32 clamped onto the heat-absorption section 11 of the heat pipe 10. The clamping section 32 is protruding and formed between two holding sections 31. In this illustrated embodiment, three clamping sections 32 are provided to correspondingly clamp the three heat pipes 10 onto the base 40. In a possible embodiment, the fixing member 30 can be a metal sheet formed by stamping.

The base 40 is located under the third portion 23 of the heat dissipation set 20 and has a top and a bottom side 41, 42; and the top side 41 of the base 40 is connected to the holding section 31 of the fixing member 30, whereas the bottom side 42 is attached to a heat-generating element. In this illustrated embodiment, the holding section 31 of the fixing member 30 is connected to the top side 41 of the base by locking, screwing, wielding, clamping, or gluing.

Figure 3:
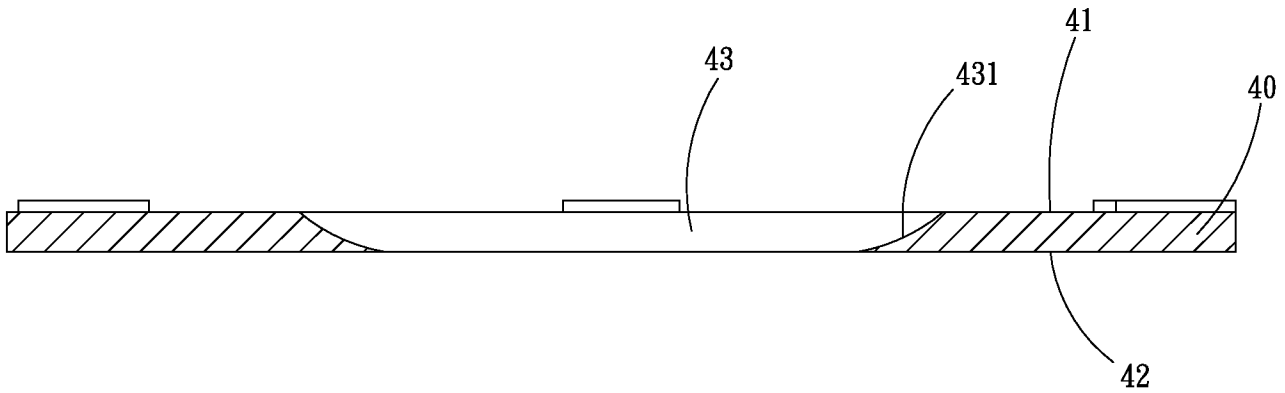
FIG. 3 is a sectional view of a base included in the combination structure of the heat dissipation module according to the preferred embodiment of the present invention.

Please refer to FIG. 3, which is a sectional view of a base included in the combination structure of the heat dissipation module according to the preferred embodiment of the present invention. The base 40 is provided with at least one groove 43, which is extended through both the top and the bottom side 41, 42 of the base 40 for receiving the heat-absorption section 11 of the heat pipe 10, and has two inner surfaces 431 which curve in a direction of an outer surface of the curved section 12 of the heat pipe 10, such that the heat-absorption section 12 of the heat pipe 10 can be tightly located in the groove 43 and a bottom of the heat-absorption section 12 of the heat pipe 10 can be on the same plane with the bottom side 42 of the base 40 to form a contact surface in contact with the heat-generating element.

The heat dissipation set 20 is located corresponding to the curved section 12 and the heat-absorption section 11 of the heat pipe 10, and the second and third slots 221, 231 are respectively gradually extended according to the curved section length CL of the curved section 12 and the horizontal length HL of the heat-absorption section 11 of the heat pipe 10, so there is no risk of an intervention occurred between the heat dissipation set 20 and the heat pipe 10, so as to increase heat transfer effect with the curved section 12 of the heat pipe 10. Also, the fixing member 30 is located in the heat dissipation set 20 to fixedly clamp the heat-absorption section 11 of the heat pipe 10 onto the base 40 to enhance the structural connected strength between the heat pipe 10, the heat dissipation set 20, and the base 40.

The present invention has been described with some preferred embodiments thereof and it is understood that many changes and modifications in the described embodiments can be carried out without departing from the scope and the spirit of the invention that is intended to be limited only by the appended claims.

What is claimed is:

1. A combination structure of a heat dissipation module comprising:

at least one heat pipe having a heat-absorption section, at least one heat-dissipation section, and at least one curved section connected to the heat-absorption section and the heat-dissipation section; the heat-absorption section having a horizontal length; the heat-dissipation section having a cross-section area, and a cross-section length being defined between a rightmost and a leftmost edge of the cross-section area; and the curved section having a curved length a heat dissipation fin set being penetrated through the heat pipe including a first portion, a second portion, and a third portion, which are located respectively corresponding to a heat-dissipation section, a curved section, and a heat-absorption section of the heat pipe; the fins of the first portion being provided with a plurality of first slots, each of which has a first slot length corresponding to a cross-section length of the heat-dissipation section of the heat pipe; the fins of the second portion and the third portion of the heat dissipation fin set being respectively provided with a plurality of second and third slots, which are gradually extended according to a length of the curved section and a horizontal length of the heat-absorption section of the heat pipe, and the fins of the third portion internally defining a receiving opening communicable with the slots.

2. The combination structure as claimed in claim 1, wherein the lengths of both the second and the third slots are longer than those of the first slots.

3. The combination structure as claimed in claim 1, wherein the receiving opening has is a fixing member located therein; and the fixing member includes at least one holding section and at least one clamping section clamped onto the heat-absorption section of the heat pipe.

4. The combination structure as claimed in claim 1, further comprising a base located under the third portion of the heat dissipation fin set; the base having a top and a bottom side; and the top side of the base being connected to the holding section of the fixing member, whereas the bottom side being attached to a heat-generating element.

5. The combination structure as claimed in claim 4, wherein the base is provided with at least one groove, which is extended through both the top and the bottom side of the base for receiving the heat-absorption section of the heat pipe, and has two inner surfaces which curve in a direction of an outer surface of the curved section of the heat pipe.

6. The combination structure as claimed in claim 1, wherein the first portion, the second portion, and the third portion of the heat dissipation fin set respectively consists of a plurality of stacked first heat radiation fins, a plurality of stacked second heat radiation fins, and a plurality of stacked third heat radiation fins.

* * * * *